US006668383B2

(12) United States Patent
Rausch et al.

(10) Patent No.: US 6,668,383 B2
(45) Date of Patent: Dec. 30, 2003

(54) HUNTING WADERS AND JACKET COMBINATION

(76) Inventors: Fred W. Rausch, 10409 Riverview Dr., Fort Smith, AR (US) 72903; Dennis J. Paskey, 3000 S. 105th St., Fort Smith, AR (US) 72903

( * ) Notice: Subject to any disclaimer, the term of this patent is extended or adjusted under 35 U.S.C. 154(b) by 0 days.

(21) Appl. No.: 10/119,111

(22) Filed: Apr. 10, 2002

(65) Prior Publication Data

US 2002/0178484 A1 Dec. 5, 2002

Related U.S. Application Data

(60) Provisional application No. 60/294,633, filed on Jun. 1, 2001.

(51) Int. Cl.[7] ..... A41D 13/02
(52) U.S. Cl. ..... 2/82; 2/69; 2/79
(58) Field of Search ..... 2/227, 81, 82, 2/242, 69, 79, 108, 85, 94, 95; 36/4, 2 R, 1.5, 2 B, 109

(56) References Cited

U.S. PATENT DOCUMENTS

| | | | | |
|---|---|---|---|---|
| 492,643 | A | | 2/1893 | Van Oostrum |
| 1,077,177 | A | | 10/1913 | Vagas et al. |
| 2,087,246 | A | | 7/1937 | Edwards |
| D113,194 | S | | 1/1939 | Storey et al. |
| 3,130,416 | A | | 4/1964 | Mitchell et al. |
| D285,140 | S | | 8/1986 | Ellenberger |
| 4,858,342 | A | | 8/1989 | Nicholson et al. |
| 4,912,860 | A | | 4/1990 | Keller |
| 5,022,096 | A | | 6/1991 | Pacanowsky |
| 5,081,718 | A | | 1/1992 | Carman et al. |
| D353,254 | S | | 12/1994 | Welch |
| D358,928 | S | | 6/1995 | Slagle et al. |
| D369,454 | S | | 5/1996 | Olsen |
| 5,901,374 | A | * | 5/1999 | Foster ..... 2/82 |
| 6,079,051 | A | * | 6/2000 | Whinston et al. ..... 2/108 |
| 6,167,571 | B1 | * | 1/2001 | Cheng ..... 2/227 |
| 6,317,893 | B1 | * | 11/2001 | Walton ..... 2/227 |
| 6,334,221 | B1 | * | 1/2002 | Hope ..... 2/69.5 |

OTHER PUBLICATIONS

Filson Catalog, Luggage 1999, p. 21, Wading Jacket.*

* cited by examiner

*Primary Examiner*—Gloria M. Hale
(74) *Attorney, Agent, or Firm*—Richard C. Litman

(57) ABSTRACT

A waders and jacket combination in which the waders and jacket are attached to each other. Because the waders and the jacket are attached to each other, the elements cannot get in between the waders and the jacket, i.e. above the waders and below the jacket. Further, the combination will prevent the separation of the waders and the jacket and the inconvenience which may occur (i.e. by misplacing one) from their separation. The instant invention insures that the waders and the jacket are always together. The attachment will preferably be made by heat sealing the waders and the jacket together. However, it is noted that any manner which accomplishes the attachment of the waders and the jacket is contemplated by this invention.

6 Claims, 3 Drawing Sheets

HUNTING WADERS AND JACKET COMBINATION

CROSS-REFERENCE TO RELATED APPLICATION

This application claims the benefit of U.S. Provisional Patent Application Serial No. 60/294,633, filed Jun. 1, 2001.

BACKGROUND OF THE INVENTION

1. Field of the Invention

The present invention relates to a waders and jacket combination in which the waders and jacket are attached to each other.

2. Description Of Related Art

Protective suits and combination garments are well-known, as shown in U.S. Design Pat. Nos. 353,254, issued on Dec. 13, 1994, 358,928, issued on Jun. 6, 1995 to Timothy Slagle et al., and 369,454 issued on May 7, 1996 to Neil Olsen. U.S. Pat. No. 492,643, issued on Feb. 28, 1893 to O. Van Oostrum, U.S. Pat. No. 2,087,246, issued on Jul. 20, 1937 to J. M. Edwards, and U.S. Pat. No. 3,130,416, issued on Apr. 28, 1964 to Jack Mitchell et al. further exemplify the state of the art in these protective garments.

Additionally, waders are common in the related art, e.g. as seen in U.S. Design Pat. No. 285,140, issued on Aug. 19, 1986 to Jack Ellenberger, and taught in U.S. Pat. No. 4,858,342, issued on Aug. 22, 1989 to Joh Nicholson et al., U.S. Pat. No. 4,912,860, issued on Apr. 3, 1990, to Robert Keller, U.S. Pat. No. 5,022,096, issued on Jun. 11, 1991 to David Pacanowsky, and U.S. Pat. No. 5,081,718, issued on Jan. 21, 1992 to David Carman et al.

Coats having head coverings are shown in U.S. Design Pat. No. 113,194, issued on Jan. 31, 1939 to Emma Story, and taught in U.S. Pat. No. 1,077,177, issued on Oct. 28, 1913 to Andrew Vagas et al.

None of the above inventions and patents, taken either singly or in combination, is seen to describe the instant invention as claimed.

SUMMARY OF THE INVENTION

The present invention is a waders and jacket combination in which the waders and jacket are attached to each other. Because the waders and the jacket are attached to each other, the elements cannot get in between the waders and the jacket, i.e. above the waders and below the jacket. Further, the combination will prevent the separation of the waders and the jacket and the inconvenience which may occur (i.e. by misplacing one) from their separation. The instant invention insures that the waders and the jacket are always together. The attachment will preferably be made by heat sealing the waders and the jacket together. However, it is noted that any manner which accomplishes the attachment of the waders and the jacket is contemplated by this invention.

Accordingly, it is a principal object of the invention to provide a waders and jacket combination which will provide comfort for the wearer due to a unitary construction.

It is another object of the invention to provide a waders and jacket combination which is permanently attached so that the combination is stored as one piece.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
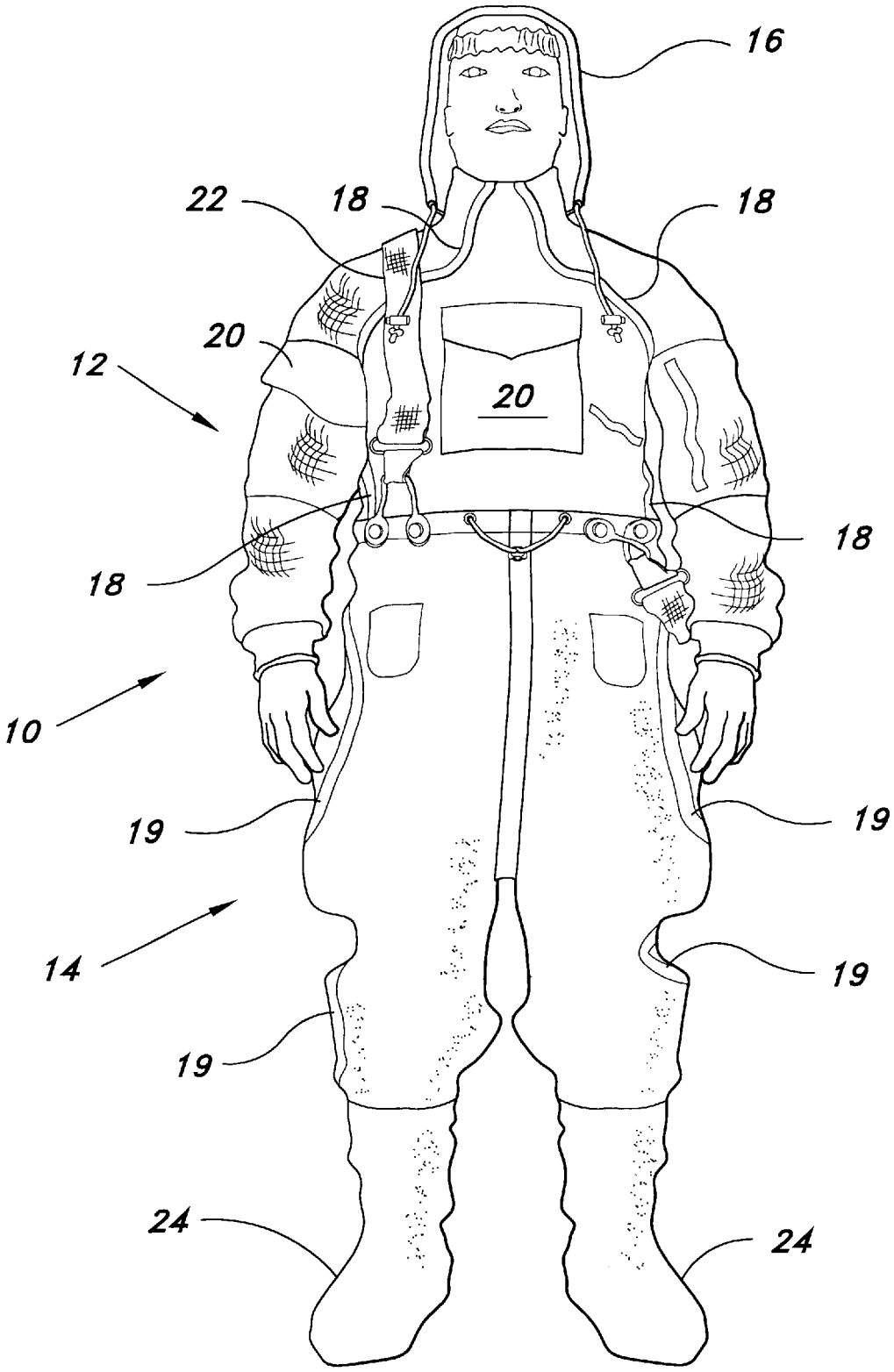
FIG. 1 is a front elevational view of a hunting waders and jacket combination according to the present invention.
Figure 2:
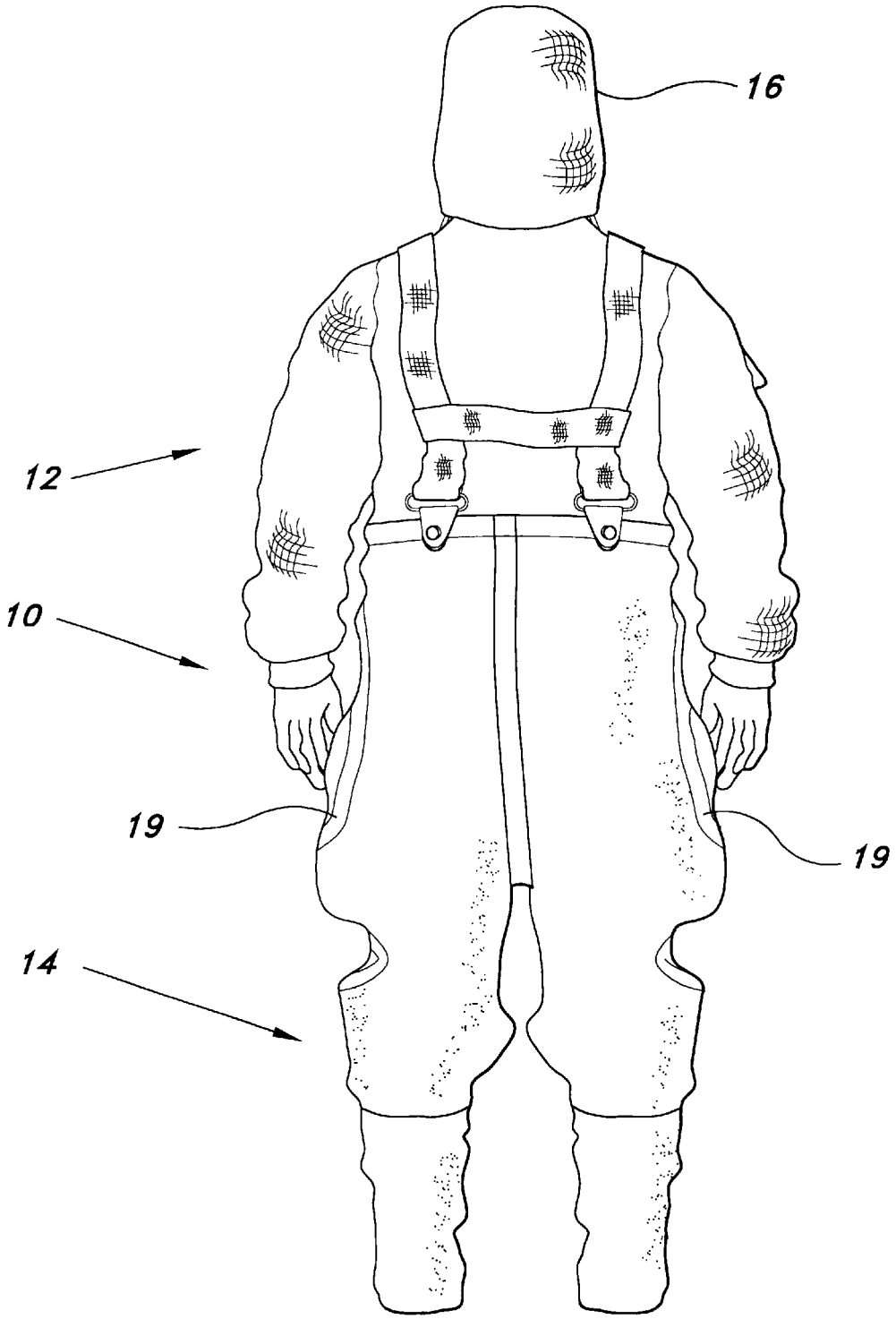
FIG. 2 is a rear elevational view thereof.

The present invention is depicted in the attached figures. FIGS. 1 and 2 show the front and rear views of an outfit 10 having a jacket 12 attached to a pair of waders 14. The jacket 12, which is waterproof, wind resistant, and breathable, includes a jacket shell (not shown) made of Gore-Tex® or canvas material. The jacket has a turtle neck collar, which may be fastened with Velcro® (not shown) or zippers that zip to the collar (shown in FIG. 1 and discussed below).

The jacket 12 includes a detachable or fold-away hood 16 and zippers 18 for forming front or side entry flaps. The zippers 18 shown in FIG. 1 indicate front entry of the outfit 10; however, it is noted that locating of the zippers to another portion of the jacket is well within the scope of the instant invention. The zippers 18 are waterproof and may be covered with a flap of material. Pockets 20 may be located on the sleeves and the front of the jacket 12 for convenient storage.

The waders 14 are waterproof and made of a material such as Cordura®, neoprene, vinyl, or rubber. The waders 14 also include zippers 19 allowing entry into the outfit. The waders 14 may include buckle-release suspenders 22 and attached boots 24. The boots 24 are preferably lined with Thinsulate®.

Figure 3:
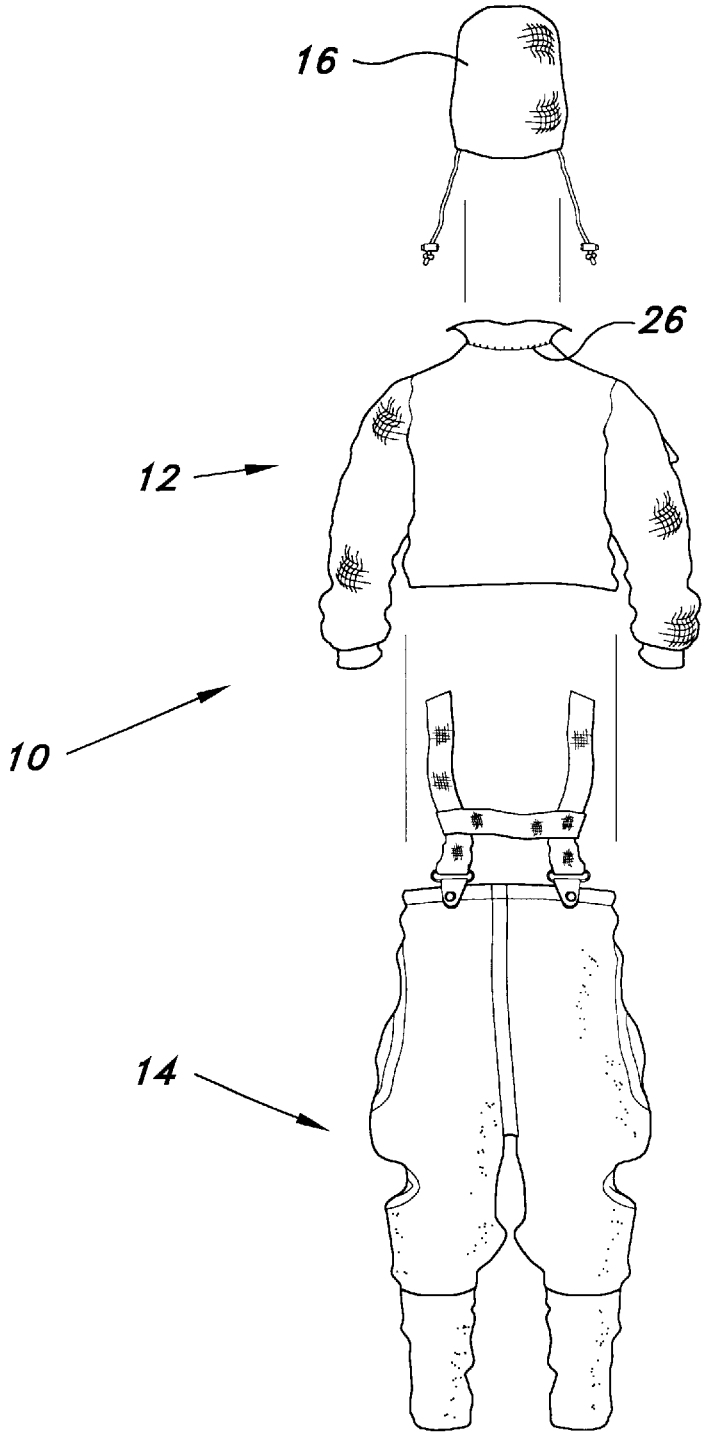
FIG. 3 is a rear exploded view thereof.

FIG. 3 shows an exploded view in which the jacket 12 and the waders 14 are shown separately before they are attached. The preferred method of attachment is heat sealing. The purpose of the permanent attachment of the waders and the jacket is to create an outfit that is ideal for activities such as hunting, where the elements can become a great factor in comfort. The hood 16 is shown detached from the jacket 12. A zipper 26 is used to facilitate their attachment.

It is to be understood that the present invention is not limited to the sole embodiments described above, but encompasses any and all embodiments within the scope of the following claims.

We claim:

1. An outfit comprising:

waders including attached boots and at least a first entry zipper; and a jacket heat sealed to said waders and including at least a second entry zipper different from the first entry zipper.

2. The outfit of claim 1 further including a detachable hood.

3. The outfit of claim 2 wherein said jacket includes a hood zipper and said hood is removably attached to said hood zipper.

4. The outfit of claim 1 wherein said waders include suspenders.

5. A method of making an outfit comprising:

providing waders including attached boots and having at least a first entry zipper;

providing a jacket having at least a second entry zipper different from the first entry zipper; and heat sealing the waders to the jacket.

6. The method of claim 5 further including attaching a hood to said jacket.

* * * * *